US009182184B2

(12) United States Patent
Emde

(10) Patent No.: US 9,182,184 B2
(45) Date of Patent: Nov. 10, 2015

(54) MAGAZINE FOR A HANDGUN

(75) Inventor: Dietmar Emde, Arnsberg (DE)

(73) Assignee: German Sport Guns GmbH, Ense-Höingen (DE)

( * ) Notice: Subject to any disclaimer, the term of this patent is extended or adjusted under 35 U.S.C. 154(b) by 32 days.

(21) Appl. No.: 14/000,606

(22) PCT Filed: Apr. 11, 2012

(86) PCT No.: PCT/DE2012/100101

§ 371 (c)(1),
(2), (4) Date: Aug. 21, 2013

(87) PCT Pub. No.: WO2012/139568

PCT Pub. Date: Oct. 18, 2012

(65) Prior Publication Data

US 2014/0068985 A1 Mar. 13, 2014

(30) Foreign Application Priority Data

Apr. 14, 2011 (DE) ..... 10 2011 002 052

(51) Int. Cl.
*F41A 9/65* (2006.01)
*F41A 9/64* (2006.01)
*F41C 3/00* (2006.01)

(52) U.S. Cl.
CPC ... *F41A 9/64* (2013.01); *F41A 9/65* (2013.01); *F41C 3/00* (2013.01)

(58) Field of Classification Search
CPC ..... F41A 9/54; F41A 9/59; F41A 9/61; F41A 9/64; F41A 9/65
USPC ..... 42/7, 6, 49.01, 49.02, 50, 49.1; 89/195, 89/197, 33.1
See application file for complete search history.

(56) References Cited

U.S. PATENT DOCUMENTS

| | | | | | |
|---|---|---|---|---|---|
| 2,427,304 | A | | 9/1947 | Robbins | |
| 3,724,326 | A | * | 4/1973 | Day | 89/196 |
| 3,772,812 | A | * | 11/1973 | Day | 42/7 |
| 4,553,469 | A | * | 11/1985 | Atchisson | 89/191.02 |
| 4,654,993 | A | * | 4/1987 | Atchisson | 42/71.01 |
| 4,693,170 | A | * | 9/1987 | Atchisson | 89/149 |
| 4,893,547 | A | * | 1/1990 | Atchisson | 89/187.01 |
| 5,113,604 | A | | 5/1992 | Vyprachticky | |
| 6,070,352 | A | * | 6/2000 | Daigle | 42/49.02 |
| 7,398,615 | B2 | * | 7/2008 | Wheatley | 42/49.01 |

FOREIGN PATENT DOCUMENTS

| | | | |
|---|---|---|---|
| BE | 660622 | A | 7/1965 |
| WO | 00/29802 | A2 | 5/2000 |

* cited by examiner

*Primary Examiner* — Jonathan C Weber
(74) *Attorney, Agent, or Firm* — Michael Soderman

(57) ABSTRACT

The invention relates to a magazine for a handgun, comprising a chamber that accommodates the ammunition and a magazine head that is suitable for being accommodated by the magazine shaft in the breechblock housing of the gun, characterized in that according to the invention an ejector plate is arranged on the magazine head and means are provided for changing the relative position of said ejector plate in the magazine shaft when a magazine is inserted. The solution according to the invention makes it possible to change the position of the magazine head in the magazine shaft by means of an adjusting mechanism and thus to also change the relative position of the ejector plate, which is now on the magazine head, in the magazine shaft. In the process, the position of the ejector plate relative to the feeding web of the breechblock generally changes. By adjusting the position of the magazine head, the ejection angle and/or the ejection path of the cartridge case and the position of the fed cartridge relative to the cartridge chamber of the weapon can also be changed if applicable.

7 Claims, 10 Drawing Sheets

MAGAZINE FOR A HANDGUN

CROSS REFERENCE TO RELATED APPLICATIONS

This application is the U.S. national stage of International Application No. PCT/DE2012/100101, filed on Apr. 11, 2012, and claims the benefit thereof. The international application claims the benefits of German Application No. 10 2011 002 052.7 filed on Apr. 14, 2011; all applications are incorporated by reference herein in their entirety.

BACKGROUND

This invention relates to a magazine for a handgun comprising a chamber that accommodates the ammunition and a magazine head that is suitable for being accommodated by the magazine well in the breech block housing of the firearm, and a handgun equipped with a magazine of that type.

A magazine for a handgun of the type mentioned above is known from U.S. Pat. No. 7,398,615 B2, for instance. Magazines of this type are especially used for cartridges with an ignition edge, wherein the cartridges have a staggered arrangement because of the ignition edge to the effect that the uppermost cartridge is positioned in the direction of firing with its ignition edge in front of the ignition edge of the cartridge underneath it, because it will only be ensured in that case that the uppermost cartridge will go into the firing channel in a controlled manner. A curved side contour results for the magazine from the staggered arrangement of the cartridges because the cartridges are narrower in front than they are in the rear area. The magazine described in the above-mentioned US document is intended to be used with 10/22 model guns of the company Ruger, for instance. It is comprised in principle of a curved magazine chamber that holds the ammunition and a magazine head that is somewhat broader vis-a-vis this chamber in an upper area. The firearm is frequently equipped with a different magazine with less capacity as a standard feature, for instance with a rotating drum magazine. The basic idea of a variable adjustment of the magazine head to the receptacle provided for it (magazine well) in the breech block housing of the firearm via a more or less major unscrewing of upward-projecting screws provided on the magazine head is already found in this document. The mechanism for the ejection of the cartridge case is still located on the breech block housing in this well-known firearm, however.

It could be the case that the magazine head is not accommodated by the breech block housing with a precise fit when the magazine is replaced due to the fact that the various models and construction years frequently have dimensional deviations in the area of the breech block housing that holds the head of the magazine in these firearms. That can in turn lead to interference with the functions of the firearm, for instance with the ejection of the cartridge case after the shot. An ejector that interacts with the extractor is customarily used for ejection; the ejector is located on the breech block housing and it carries out its function, meaning the ejection of the cartridge case, during the movement of the breech after the firing of the cartridge.

This invention starts off here. The task of this invention is to provide a magazine for a handgun of the type mentioned above that permits an adjustment for dimensional deviations of the firearm caused by different models or construction years, especially with regard to the function of the ejector.

A magazine for a handgun of the type mentioned above with the characterizing elements of the main claim solves this problem.

DETAILED DESCRIPTION

The invention envisages that an ejector plate is arranged on the magazine head and means are provided to change the relative position of this ejector plate in the magazine well when the magazine is inserted.

The solution as per the invention makes it possible for the position of the magazine head to be changed in the magazine well via an adjustment mechanism and for the relative position of the ejector plate, which is now located on the magazine head, to also be changed in the magazine well because of that. The position of the ejector plate vis-a-vis the feeding web of the breech block changes in the process as a rule. The ejection angle and/or the ejection path of the cartridge case can still be changed if necessary, as well as the position of the fed-in cartridge vis-a-vis the cartridge chamber of the firearm if necessary, via the adjustment of the position of the magazine head. Because of the adjustment possibilities that result from the solution as per the invention, the magazine head of the magazine that is used in each case can be adjusted to the most diverse models and construction years of the corresponding firearm type in such a way that proper operation of the ejection of the cartridge case is ensured in each case.

A preferred further design form of this invention envisages that the ejector plate is attached to the magazine head in a detachable and consequently replaceable manner. There are preferably also provisions for the ejector plate to be fastened in a detachable way to the magazine head by clamping it on or screwing it on or attaching it in a different manner. This has the advantage vis-a-vis the prior solutions that the magazine head no longer has a cast-on ejector edge. Different ejector plates can now be optionally attached to the magazine head that precisely fit the model and the construction year of the respective firearm. In addition, an ejector plate that is worn out from use, for example, can be replaced. The previously used ejector edge that was directly cast onto the magazine head had the drawback, among others, that it wore out more quickly then the ejector plate as per the invention.

A preferred further possible design form of the problem solution as per the invention envisages that the magazine head is mounted in the magazine well of the firearm in such a way that it can swivel around an axis running parallel to the barrel axis and that at least one adjustment screw is provided whose axis runs crosswise and at a distance to this swivel axis and extends in an essentially horizontal fashion into the magazine head when the magazine is inserted; a setting change to this adjustment screw brings about a swiveling movement of the magazine head around its swivel axis. The position of the ejector plate in the magazine well and therefore also its position vis-a-vis the barrel axis of the firearm can consequently be changed via a setting change to an adjustment screw of that type.

As a special preference, at least two adjustment screws of that type are used, once again as a preference, with one located on the right and one located on the left-hand side of the magazine head. As a further preference, at least two adjustment screws with axes running parallel to one another are used on one side of the magazine head, and four or more adjustment screws can consequently be provided, as an example, two of which are located on the right-hand side in each case and two of which are located on the left-hand side of the magazine head; each of these screws, when adjusted, brings about a swiveling movement or rotation of the magazine head around its axis, which is ideally aligned in parallel with the barrel axis. The magazine head can consequently either be swiveled towards the right or towards the left-hand side.

A preferred further design form of the problem solution as per the invention provides for the ejector plate to be comprised of a canted sheet-metal element that can at least partially be inserted into a groove or recess in the upper part of the magazine head and fixed in place there. It can be partially accommodated in the above-mentioned groove with an interlocking form fit, and a type of guide can result in this groove when the ejector plate is inserted. The ejector plate can consequently be easily exchanged, for instance when it is worn out from use.

An upper, canted section of the ejector plate preferably extends upwards beyond the upper boundary of the magazine head and projects laterally inwards behind the ignition edge of the cartridge in the loading position, whereas a section of the ejector plate located beneath that engages in a groove or recess of the magazine head. This upper, canted section of the ejector plate consequently takes on the ejector function, whereas the area of the ejector plate below that serves to fasten it to the magazine head.

A handgun that is equipped with a magazine of the type described above is also part of the subject matter of this invention.

The features specified in the sub-claims relate to preferred further design forms of the problem solution in accordance with the invention. Further advantages of the invention ensue from the following detailed description.

This invention will be described in more detail below with the aid of examples making reference to the enclosed drawings.

BRIEF DESCRIPTION OF THE DRAWINGS

The following are shown here.

DETAILED DESCRIPTION OF THE PREFERRED EMBODIMENT

Figure 1:
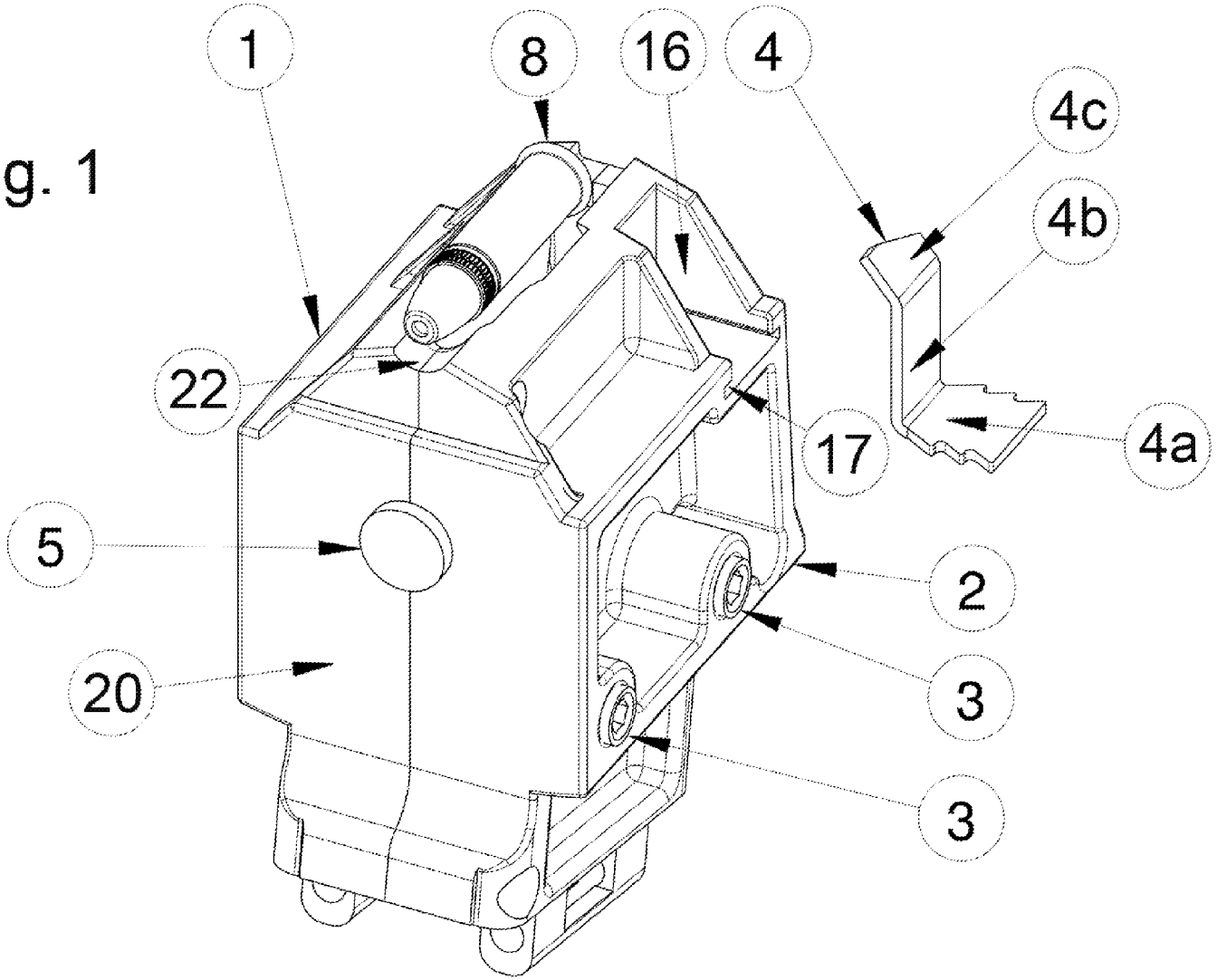
FIG. 1 shows a partially exploded view in perspective of the magazine head of a magazine as per the invention.
Figure 5:
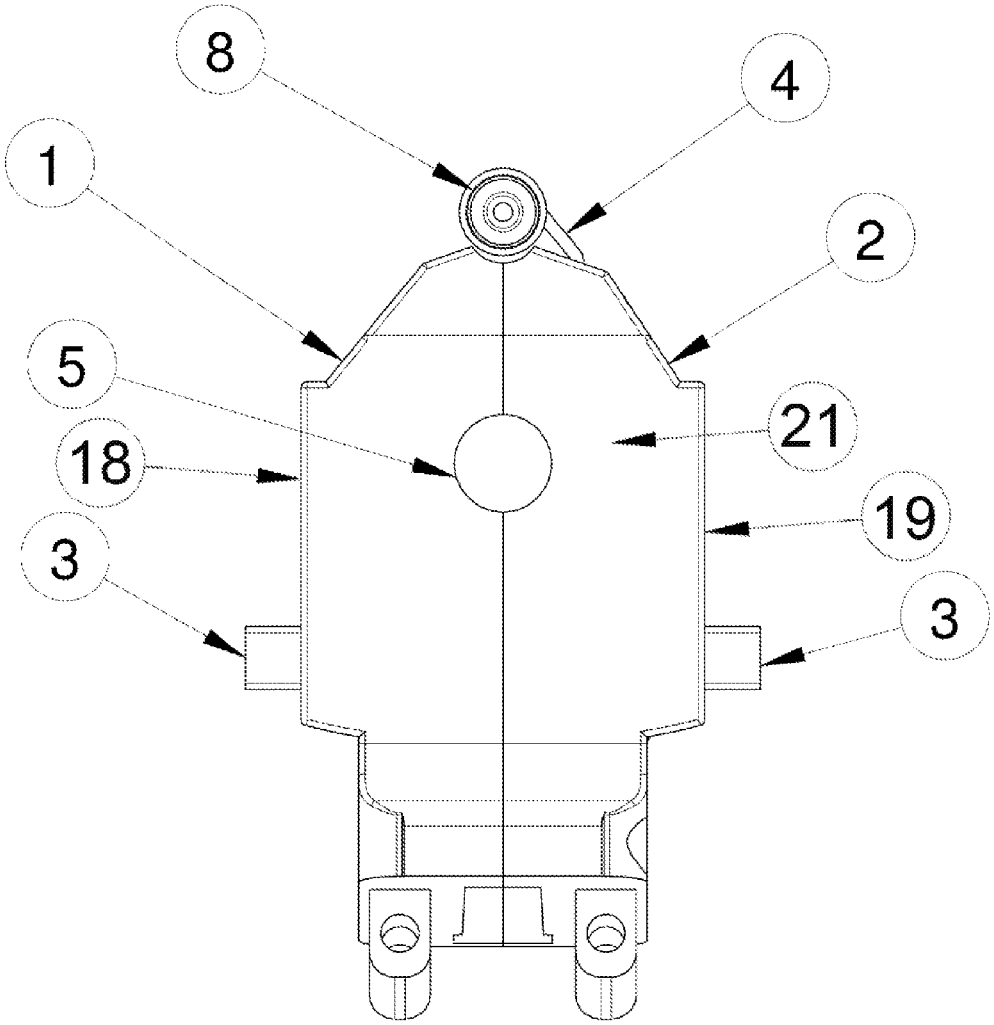
FIG. 5 shows the view of the magazine head corresponding to FIG. 4 from the rear.
Figure 6:
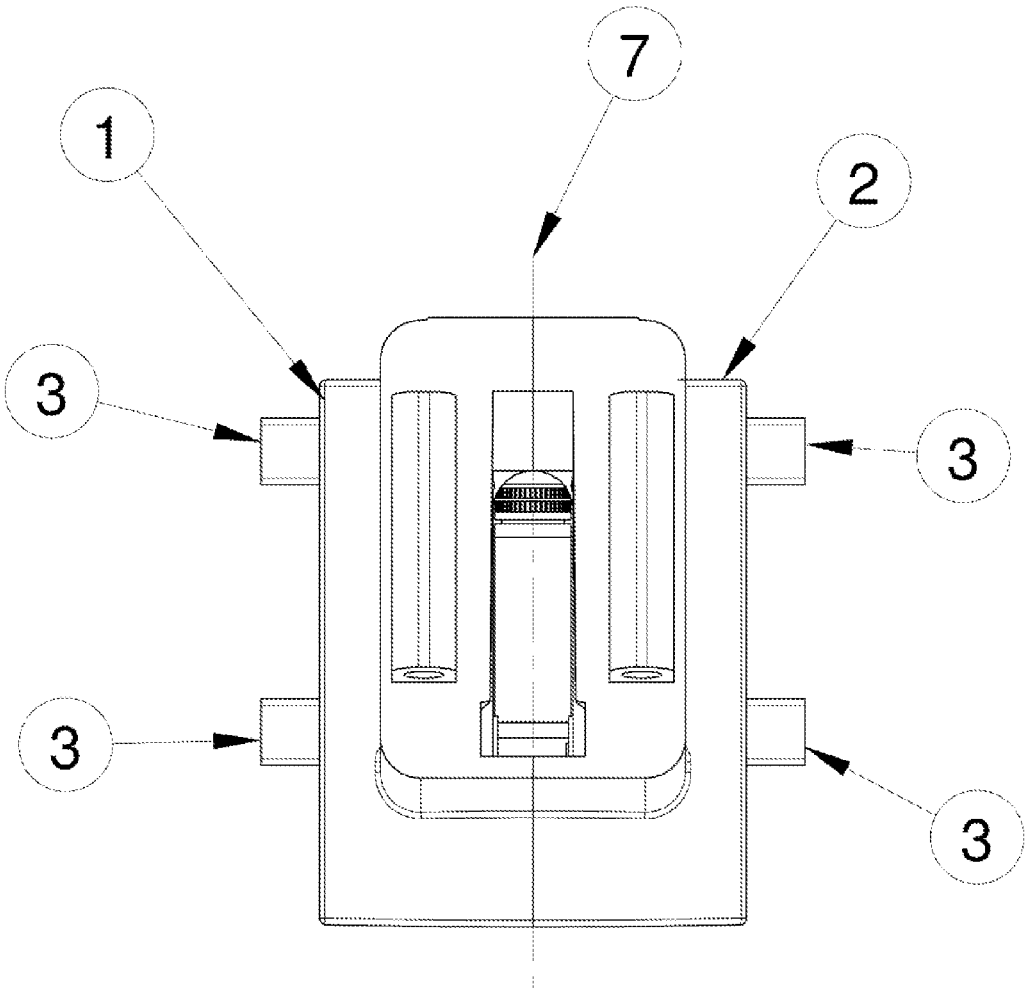
FIG. 6 shows a view of the magazine head from the bottom.

Reference is made to FIG. 1, to start with, and the essential elements of a magazine head as per the invention, which is indicated as a whole with reference number 1, will be explained with the aid of this illustration. A cartridge chamber that is not shown here, accommodating a fairly large number of cartridges, preferably cartridges with an ignition edge, which are gradually conveyed towards the top via a feed unit in the magazine and output there into the firing channel of the firearm in each case, is connected in the lower area to the magazine head 1. The magazine head 1 that is shown is somewhat broader vis-a-vis the cartridge chamber; the lower section that can be seen in FIG. 1 is roughly as wide as the cartridge chamber. The uppermost cartridge 8 is shown in the drawing. The ejector plate 4 is shown in a disassembled state. As can be seen, a recess 16 in which this ejector plate is held is located on one side of the magazine head 1; the ejector plate is inserted from the side into the recess 16 that is open towards the outside. The magazine head has a front wall, two side walls 18, 19 arranged at right angles to it that have hollowed-out areas, and a rear wall 21, evident in FIG. 5, that runs parallel to the front wall and consequently at right angles to the side walls. It is further evident from FIG. 5 that the magazine head tapers in towards the top on both sides in a symmetrical fashion towards the center (also see FIG. 1); a trough-shaped support 22 is provided at the top for the cartridge 8 that has been output and that is to be fired.

The ejector plate 4 is a canted sheet-metal plate with a lower section 4*a* angled at about 90° that is aligned horizontally outwards when mounted, a section 4*b* that extends vertically upwards when mounted and an upper, canted section 4*c* that extends from the section 4*b* inwards at its upper end. The two sections 4*a* and 4*b* roughly have an L shape, viewed from the side, whereas the upper, canted section 4*c* is canted from the plane of the section 4*b* at an acute angle inwards towards the magazine head. A T-shaped groove 17 that holds section 4*a* of the ejector plate 4 when it is inserted and that acts as a guide for it during insertion is located in the lower area of the recess 16. Moreover, this section 4*a* has a type of sawtooth structure at its outer edges, so there is a clamping effect in the groove 17 when the ejector plate is inserted. The latter can be removed from the recess and replaced when necessary, however.

Figure 2:
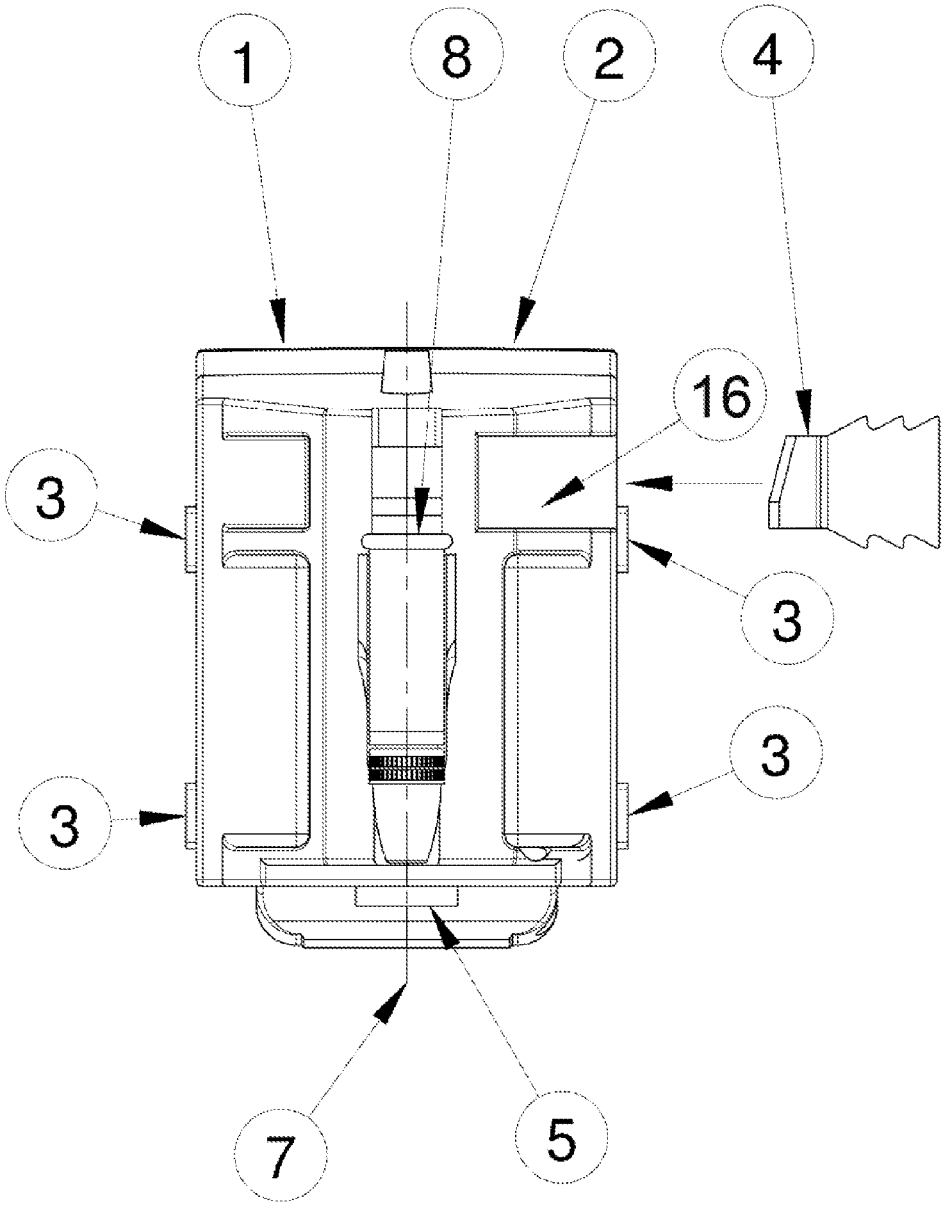
FIG. 2 shows a corresponding top view of the magazine head of FIG. 1.

The precise shape of the ejector plate 4 follows when FIGS. 1 and 2 are viewed together. One sees that the upper, canted section 4*c* is predominantly beveled, so only a short area at the front, viewed in the direction of a shot, shows a horizontal edge that a beveled edge is then connected to towards the back.

The ejector plate 4 is also shown in a disassembled state in FIG. 2; the magazine head 1 is viewed from the top in FIG. 2. The ejector plate 4 is shown in its position when it is inserted into the recess 16 in FIG. 3. One sees here that the upper, canted section 4*c* is positioned behind the ignition edge of the cartridge 12.

Figure 7:
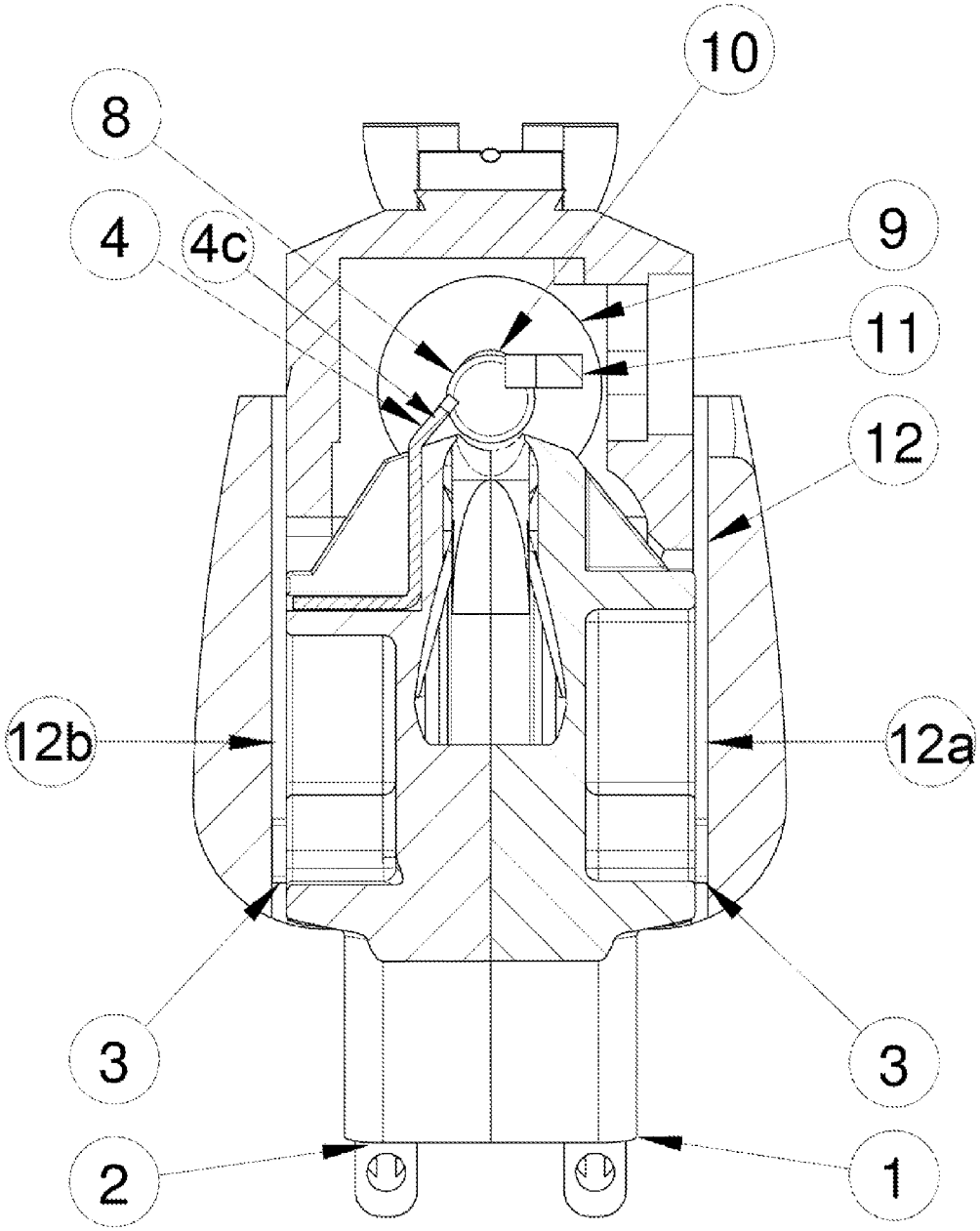
FIG. 7 shows a sectional view of a magazine head that has been inserted in the center of the magazine well of the firearm; the view of the cartridge is from the rear.

The magazine head 1 is mounted in a magazine well 12 of a handgun around a roughly horizontal axis 7 running through the magazine head 1 in the longitudinal direction so as to be capable of swiveling to a certain extent to thereby balance out dimensional deviations in the well for different construction years and models of the same type of firearm This is shown in the sectional view in accordance with FIG. 7; a neutral position of the magazine head 1 in the center of the magazine well 12 is shown there. The section shows a view from the rear towards the base of the cartridge 12, and one also sees here how the upper cant 4*c* of the ejector plate 4 reaches behind the ignition edge of the cartridge 12. To achieve this swiveling support of the magazine head 1, it has a front bearing seat 5, identifiable in FIG. 1 and located in the front wall 20 of the magazine head, that forms a swivel bearing together with the rear bearing seat 6, identifiable in FIG. 3 and in the side view in accordance with FIG. 4, that is located at the same height in the rear wall 21 of the magazine head; the axis around which the magazine head 1 swivels or tilts in the magazine well is indicated in FIG. 4 with the reference number 7. The bearing seat 5 is a cylindrical, knob-type projection, and the bearing seat 6 is a conical projection; both of the bearing seats engage in correspondingly shaped recesses (not shown here), for instance, when the magazine head is supported in the magazine well, so pivot bearings result in each case. In the rear view of the magazine head in accordance with FIG. 5, the rear bearing seat 6 and its position in the rear wall of the magazine head 1 can be identified and one also sees the adjustment screws 3 arranged laterally in a deeper position on the outside of the two side walls of the magazine head.

Figure 3:
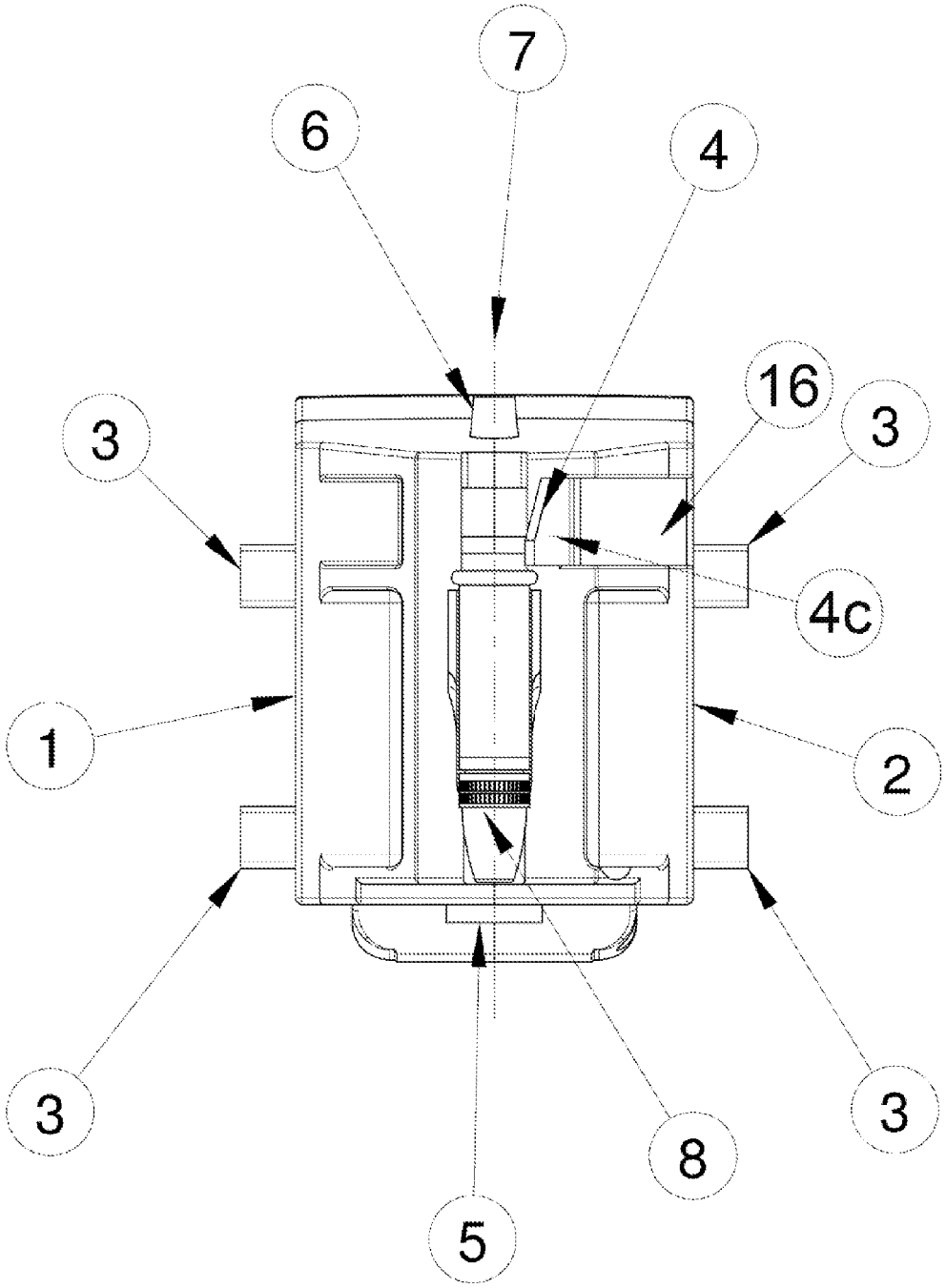
FIG. 3 shows top view similar to that of FIG. 2, but the ejector plate was inserted into the corresponding recess of the magazine head here.
Figure 4:
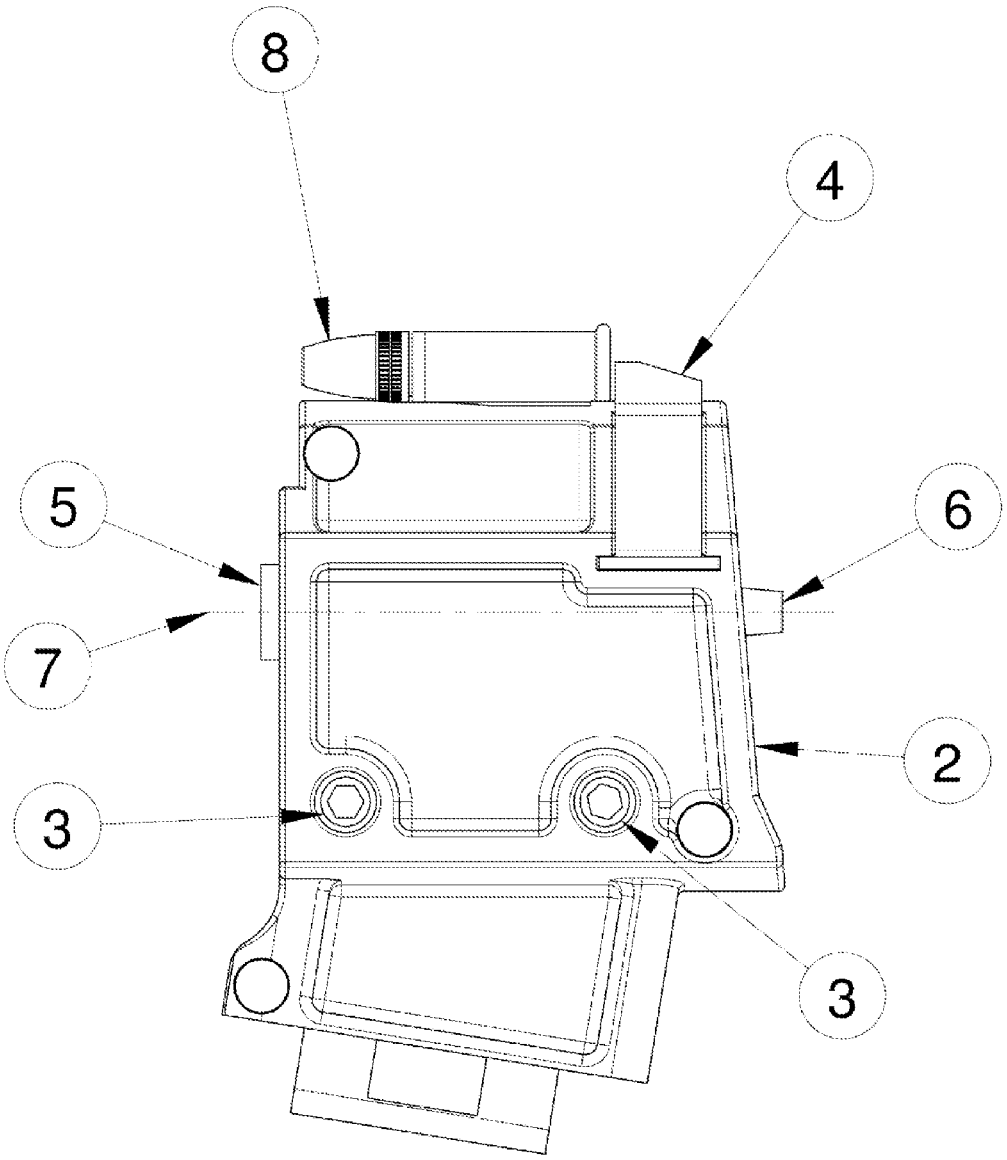
FIG. 4 shows the side view corresponding to FIG. 3 with the inserted ejector plate.

Reference is now made to FIGS. 1 and 3. The total of four adjustment screws 3 are identifiable there that serve to bring about an adjustment of the magazine head 1 in the magazine well 12 via a swiveling or tilting movement. Two adjustment screws 3 each are located on each side of the magazine head and, in fact, to the effect that they are opposite one another in pairs in each case; two adjustment screws each are arranged in parallel and at a spacing to one another on each side, wherein one of the adjustment screws is positioned more towards the rear on the side of the magazine head in each case and the other one is positioned more towards the front in each case. The adjustment screws 3 can be set with a suitable tool that creates a turning action, for instance a socket wrench or the like (see FIG. 1). The axis of these adjustment screws crosses the vertical central plane through the magazine head 1 in which the swivel axis 7 is also located, which runs from the front to the back and thus in a longitudinal direction through the magazine head. The axes of the adjustment screws 3 run in a crosswise direction to the magazine head and consequently crosswise to the longitudinal direction of the swivel axis 7 in principle, but these axes do not directly cross the swivel axis, because they run crosswise to it underneath the swivel axis; the axes of all four adjustment screws 3 when installed in the central neutral position of the magazine head are in a horizontal plane that crosses the vertical, central plane through the magazine head. Each of the outer ends of the heads of the adjustment screws 3 abuts the surface of the vertical interior wall 12*a* on the right-hand side or the vertical interior wall 12*b* on the left-hand side of the magazine well 12 in each case, as seen in FIG. 7. The magazine head 1 is held in the center of the magazine well 12 in the neutral position because of that, as is easily identifiable in FIG. 7.

The mechanism of adjusting the magazine head 1 in the magazine well 12 with tilting around the swivel axis 7 will now be explained in more detail below with reference to FIGS. 7 to 10. FIG. 7 shows the central starting position or neutral position in which, as can be seen, the adjustment screws 3 on both sides of the magazine head project out by the same amount and the gap between the magazine head 1 and the interior wall of the magazine well 12*a* on the right-hand side or 12*b* on the left-hand side is consequently equally wide everywhere in an ideal case. In FIG. 7, the uppermost, ready-to-fire cartridge 8 that was output from the magazine can be identified and the barrel 9 of the firearm, the barrel bore 10 and the extractor 11, as well as the ejector plate 4 as per the invention, which reaches with its upper, canted section 4 *c* behind the ignition edge of the cartridge 8.

Figure 8:
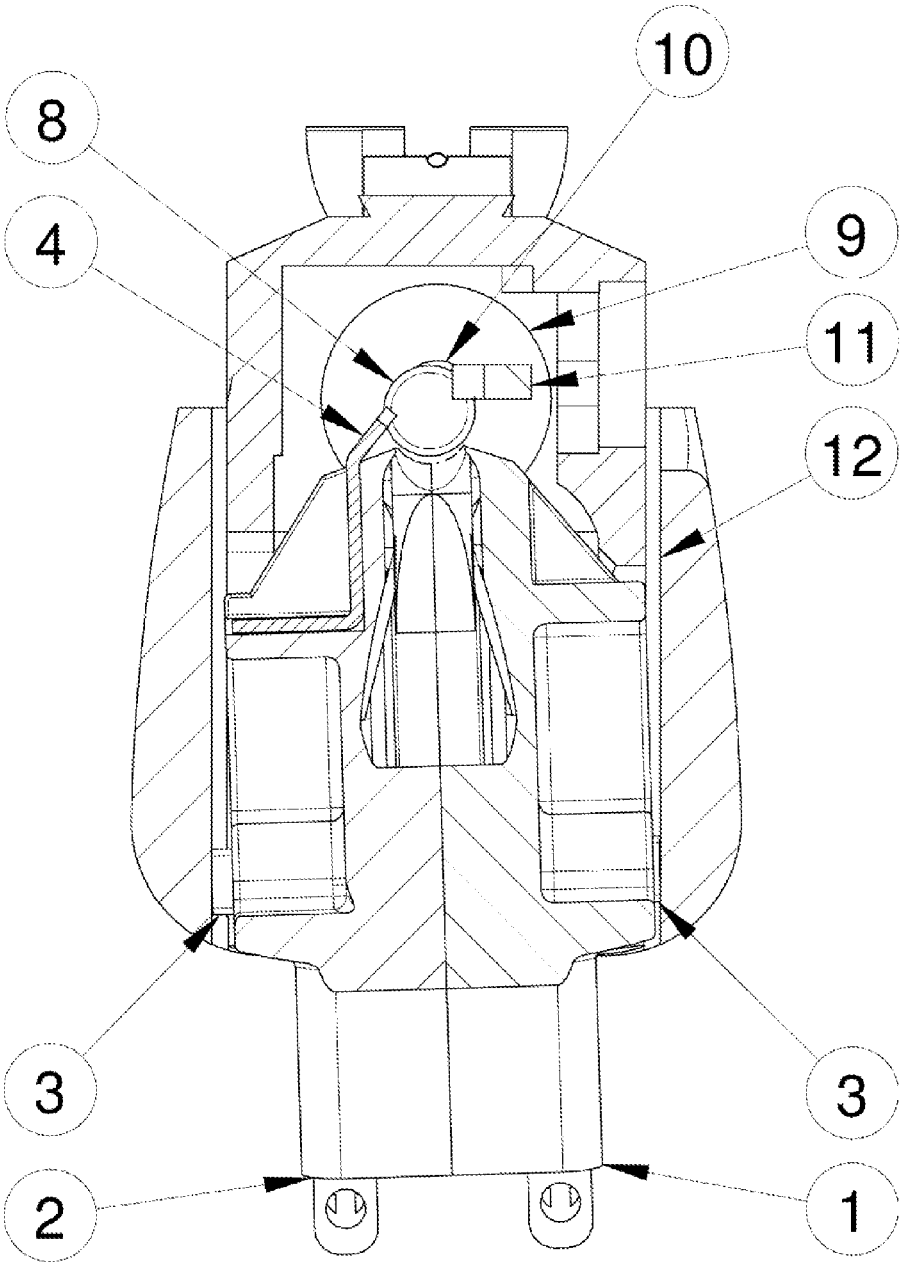
FIG. 8 shows a corresponding sectional view, but the magazine head has been arranged to tilt towards the left in the magazine well here.
Figure 9:
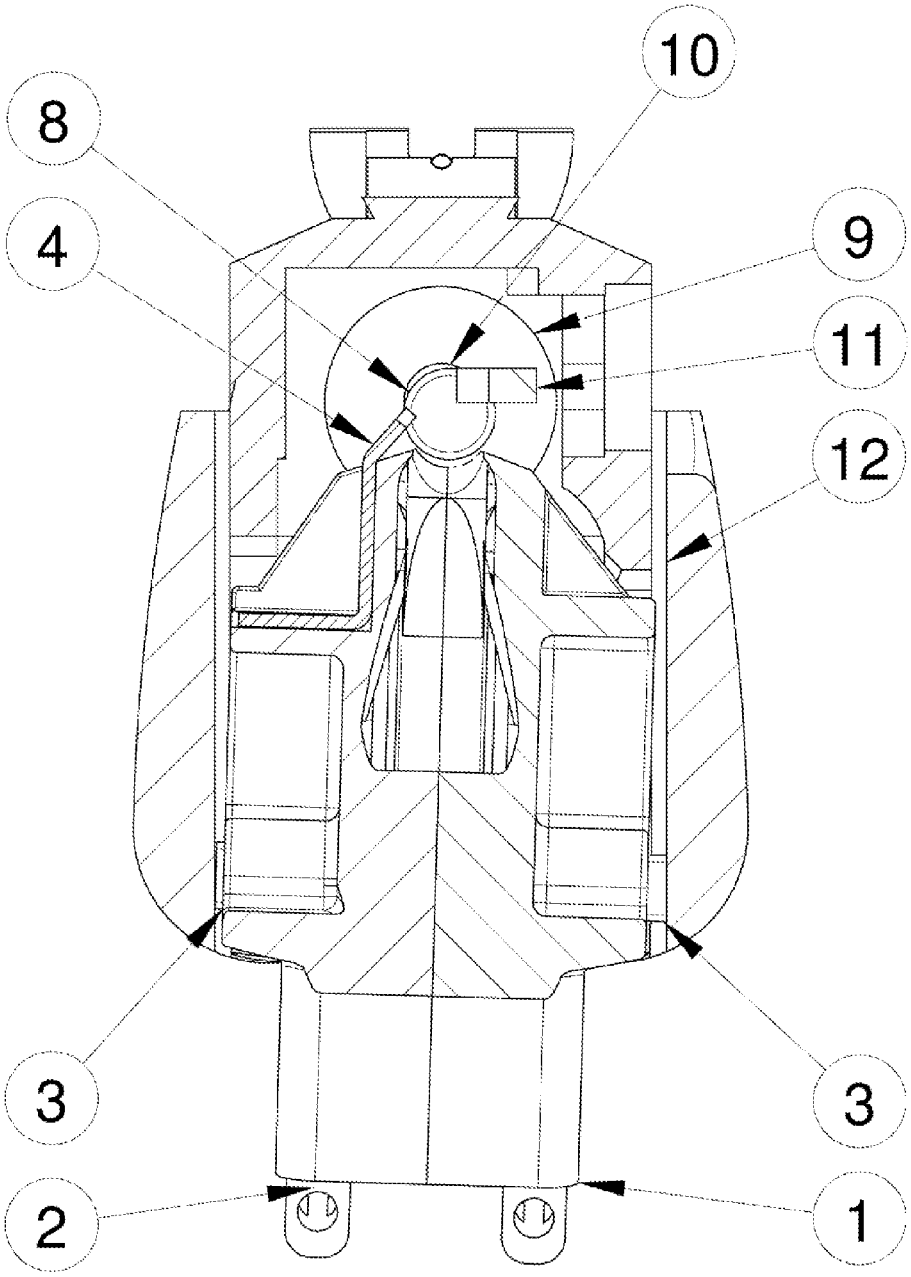
FIG. 9 shows a sectional view corresponding to FIG. 8, but the magazine head has been arranged to tilt towards the right in the magazine well here.

In the position shown in FIG. 8, the adjustment screws 3 on the left-hand side were now unscrewed further than those on the right-hand side of the magazine head, which leads to a swiveling of the magazine head 1 in the magazine well 12 and therefore to an asymmetrical tilted position in which, as can be seen, the magazine head tilts towards the left. The relative position of the magazine head changes vis-a-vis the breech block housing of the firearm because of that, and the relative position of the ejector plate changes because it is fastened to the magazine head. The relative position of the cartridge 8 likewise changes vis-a-vis the extractor 11 and the barrel bore 10, as can easily be identified by comparing the two views of FIG. 7 and FIG. 8. It is evident from FIG. 9 that the adjustment screws 3 on both sides can also be adjusted in such a way that the magazine head 1 tilts to the right vis-a-vis the magazine well 12 and the breech block; the adjustment screws 3 on the right-hand side are now longer and those on the left-hand side are shorter because they were screwed further into the magazine head in the horizontal direction. The position of the ejector plate 4 and consequently its position vis-a-vis the firearm axis in turn changes compared with the central neutral position in accordance with FIG. 7.

Figure 10:
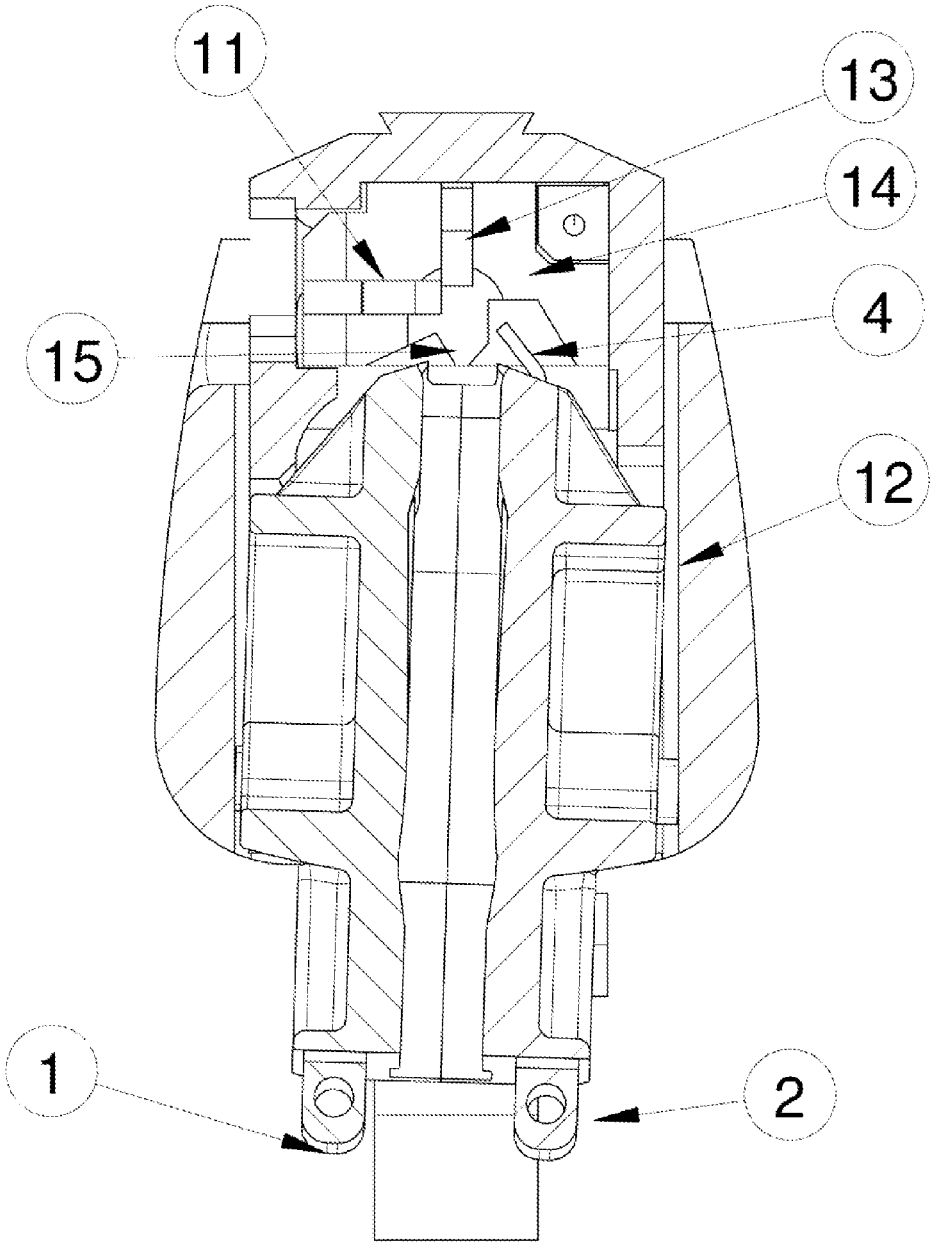
FIG. 10 shows a further sectional view in which the magazine head located in the magazine well is viewed from the front; the magazine head is tilted towards the left as in the view of FIG. 8.

FIG. 10 shows the position corresponding to FIG. 8 with a magazine head 1 tilted towards the left in the magazine well 12. Since the view is from the front, it is naturally tilted to the right in FIG. 10. The changed position of the ejector plate 4 at the upper end of the tilted magazine head is also identifiable in FIG. 10; one still sees the extractor 11, the firing pin 13, the breech block 14 and the feeding web 15.

LIST OF REFERENCE NUMERALS

1 Magazine head
3 Adjustment screws
4 Ejector plate
5 Front cylindrical bearing seat
6 Rear bearing seat
7 Axis of rotation
8 Cartridge
9 Barrel
10 Barrel bore
11 Extractor
12 Magazine well
13 Firing pin
14 Breech block
15 Feeding web
16 Recess
17 Groove
18 Side wall
19 Side wall
20 Front wall
21 Rear wall
22 Trough-shaped support

The invention claimed is:

1. Magazine for a handgun comprising a chamber that accommodates ammunition and a magazine head that is suitable for being accommodated by a magazine well in a breech block housing of a firearm, characterized in that an ejector plate is arranged on the magazine head and means are provided to change the relative position of this ejector plate in the magazine well when the magazine is inserted, wherein the ejector plate is attached to the magazine head in a detachable and consequently replaceable manner and wherein the ejector plate comprises a canted sheet-metal element that can at least partially be inserted into a groove or recess in the upper part of the magazine head and fixed in place there, said canted sheet-metal element having a lower section angled at about 90° that is aligned horizontally outwards when mounted, wherein there is a T-shaped groove in the lower area of the recess that holds the lower section of the elector plate when said lower section is inserted and that acts as a guide for said lower section during insertion and wherein this lower section has a sawtooth structure at its outer edges so that a clamping effect exists in the groove when the ejector plate is inserted.

2. Magazine for a handgun according to claim 1, characterized in that the ejector plate is fastened in a detachable way to the magazine head by clamping it on.

3. Magazine for a handgun according to claim 1, characterized in that the magazine head is mounted in the magazine well of the firearm in such a way that it can swivel around an axis running parallel to the barrel axis and that at least one adjustment screw is provided whose axis runs crosswise and at a distance to this swivel axis and extends in an essentially horizontal fashion into the magazine head when the magazine is inserted, wherein a setting change to this adjustment screw brings about a swiveling movement of the magazine head around its swivel axis.

4. Magazine for a handgun according to claim 3, characterized in that at least two adjustment screws are provided, at least one of which is arranged on the right and at least one of which is arranged on the left-hand side of the magazine head.

5. Magazine for a handgun according to claim 3, characterized in that at least two adjustment screws are arranged on at least one side of the magazine head and their axes run parallel and at a distance to one another.

6. Magazine for a handgun according to claim 1, characterized in that an upper, canted section of the ejector plate extends upwards beyond the upper boundary of the magazine head and projects laterally inwards behind the ignition edge of the cartridge in the loading position, whereas a section of the ejector plate located beneath that engages in a groove or recess of the magazine head.

7. Handgun characterized in that it is equipped with a magazine with the features of claim 1.

* * * * *